US005655776A

United States Patent [19]

Kaulfuerst

[11] Patent Number: 5,655,776

[45] Date of Patent: Aug. 12, 1997

[54] GAME BALL GOAL ASSEMBLY

[76] Inventor: Julius O. Kaulfuerst, W212 N10388 Oak Ct., Colgate, Wis. 53017

[21] Appl. No.: 576,449

[22] Filed: Dec. 21, 1995

[51] Int. Cl.[6] ..... A63B 69/00; A63B 69/36

[52] U.S. Cl. ..... 473/187; 473/446

[58] Field of Search ..... 473/187, 188, 473/189, 180, 185, 186; 273/411, 398, 400, 127 B

[56] References Cited

U.S. PATENT DOCUMENTS

| | | | |
|---|---|---|---|
| 532,132 | 1/1895 | Zaremba | 532/132 |
| 1,112,075 | 9/1914 | Lush | 473/189 |
| 1,208,235 | 12/1916 | Thayer et al. | 273/105 |
| 1,392,662 | 10/1921 | Seibold | 273/105 |
| 1,427,537 | 8/1922 | Long | 473/187 |
| 1,823,487 | 9/1931 | Clear | 473/187 |
| 2,112,281 | 3/1938 | Ferris . | |
| 2,283,462 | 5/1942 | Richie | 473/187 |
| 2,311,767 | 2/1943 | Lumbard | 294/86 |
| 2,434,358 | 1/1948 | Frank | 174/84 |
| 2,742,293 | 4/1956 | Davis | 473/188 |
| 3,338,579 | 8/1967 | McKain | 473/188 |
| 3,856,342 | 12/1974 | Kelly | 294/67 R |
| 4,127,272 | 11/1978 | Pennell | 273/102 |
| 4,359,225 | 11/1982 | Baldorossi et al. | 473/187 |
| 4,647,047 | 3/1987 | Little | 473/187 |
| 4,809,988 | 3/1989 | Hunter | 473/188 |
| 5,000,461 | 3/1991 | Borazjani | 273/401 |
| 5,395,122 | 3/1995 | Kraemer | 273/400 |

*Primary Examiner*—Mark S. Graham
*Attorney, Agent, or Firm*—Whyte Hirschboeck Dudek S.C.

[57] ABSTRACT

A goal assembly is disclosed for receiving and retaining a game ball, such as a soccer ball. The goal assembly has a base for placement on a playing surface and is ramped downwardly toward the playing surface for receiving an incoming rolling game ball thereover. The goal assembly also has a side assembly flexibly attached to the base and extending upwardly. The side assembly has a target opening at an upper end of the side assembly and allows the incoming rolling game ball to compress one side of the upwardly extending side assembly and cause the remaining portion of the side assembly to contract in a direction opposite of the incoming game ball, thereby trapping the game ball within the goal assembly. The goal assembly is particularly desirable in pairs for playing various games. In the preferred embodiment, the goal assembly is sized for receiving a soccer ball, and is very useful as a soccer practice goal. However, the goal assembly can readily be sized for other game balls, such as for play with golf balls.

14 Claims, 1 Drawing Sheet

GAME BALL GOAL ASSEMBLY

BACKGROUND OF THE INVENTION

The invention relates to a ball target, and more particularly to a goal assembly for receiving and retaining a game ball.

While soccer is still a relatively minor sport in the United States, it is a rapidly growing sport. As a result, there are not enough available fields for play, let alone for practice. It would thus be desirable to have a small, light weight and portable goal assembly for practicing the game of soccer and honing the skills involved in eye-foot coordination.

It would also be desirable to have a lawn game having a pair of such lightweight, portable, and inexpensive ball targets in which players could kick a game ball into the game target for achieving points in various games.

It is also desirous to have a small, portable golf ball target for receiving and retaining a golf ball for practicing of the game of golf.

SUMMARY OF THE INVENTION

The present invention provides a ball target satisfying the aforementioned needs. The ball target has a base for receiving a rolling game ball thereover and an upwardly extending side assembly having an upper end and a lower end. The lower end of the side assembly is flexibly attached to the base, and the upper end forms a target opening. When the rolling game ball rolls over the base and contacts the side assembly, pressure from the ball on one portion of the side assembly, causes contraction of the remaining side assembly to retain the game ball within the target opening.

In a preferred embodiment, the ball target is sized for play with a soccer ball such that a player can aim and kick the soccer ball toward the goal assembly, and if accurate, the soccer ball will roll over the base of the goal assembly and exert force on one side of the side assembly forcing that side of the side assembly inwardly and downwardly, thereby causing the remaining portion of the side assembly to contract and stop the game ball from proceeding out the opposite end of the goal. The side assembly is biased to the upwardly extending position such that the game ball is thereby trapped in the goal assembly.

Various games can be played with the ball target of the present invention, including practicing the game of soccer or golf. One skilled in the art will recognize that the ball target of the present invention can be constructed to accommodate any size game ball.

Various other features, objects, and advantages of the invention will be made apparent by the following detailed description taken together with the drawings.

BRIEF DESCRIPTION OF THE DRAWINGS

The drawings illustrate the best mode presently contemplated for carrying out the invention.

In the drawings.

DETAILED DESCRIPTION OF THE PREFERRED EMBODIMENT

Figure 1:
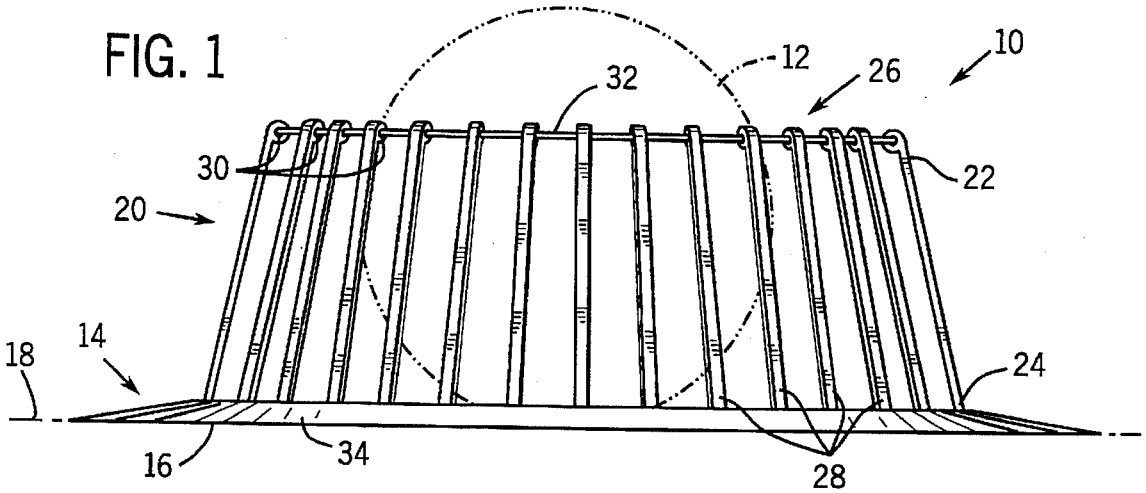
FIG. 1 is a side perspective view of the ball target of the present invention.
Figure 2:
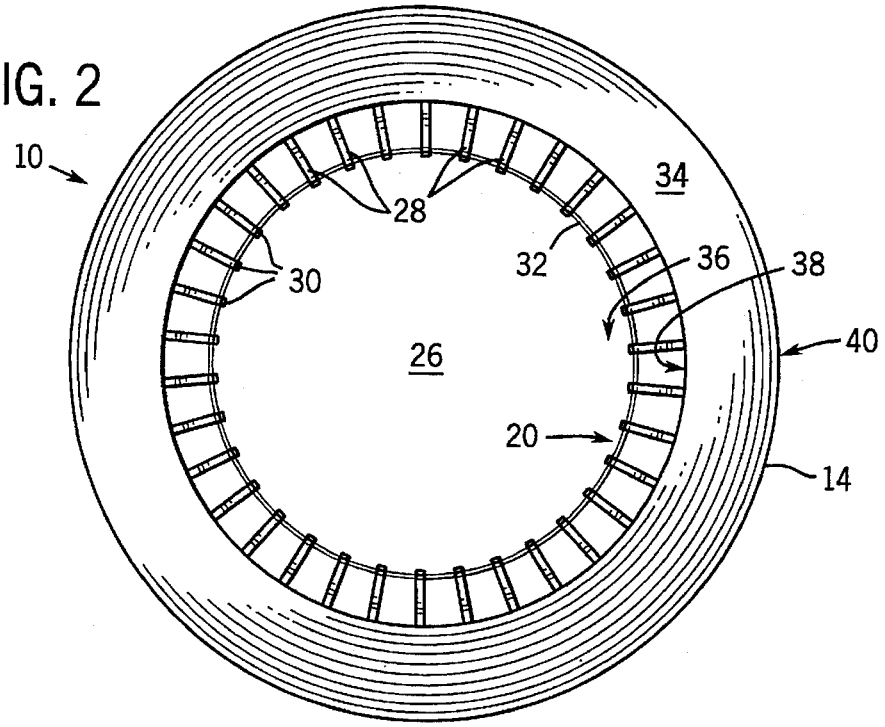
FIG. 2 is a top view of the ball target of FIG. 1.

FIG. 1 shows a ball target, or goal assembly 10 for receiving and retaining a game ball 12. Ball target 10 has a base 14 having a substantially planar bottom side 16 for placement on a playing surface 18. Ball target 10 has an upwardly extending side assembly 20 having an upper end 22 and a lower end 24. The lower end 24 is flexibly attached to base 14 and the upper end forms a target opening 26, as best shown in FIG. 2.

In a preferred embodiment, side assembly 20 is formed from a plurality of upwardly extending side elements 28 that are biased outwardly to normally remain in the upward direction, The side elements 28 have an eyelet 30 at their upper ends 22, The side assembly 20 of ball target 10 also has a flexible cord 32 threaded through the eyelets 30 of side elements 28. However, the eyelets may be replaced with any other form of retention, such as hooks, The base 14 of ball target 10 has a ramped upper side 34 extending downwardly from the side assembly 20 to the playing surface 18 for receiving a rolling game ball 12 thereover.

Although ball target 10 is shown and described with a circular base 14, various other configurations are contemplated and within the scope of the appended claims. Base 14 can have a hollowed center 36, FIG. 2, and an inner diameter 38 sized to accommodate the desired game ball 12 therein. Similarly, an outer diameter 40 is sized according to the inner diameter 38, the size of the desired game ball 12, and the degree of inclination of the ramped upper side 34 of base 14.

Figure 3:
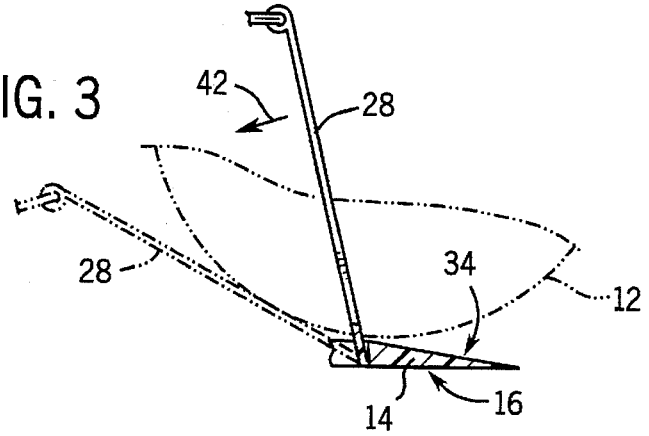
FIG. 3 is a cross-sectional view of a portion of FIG. 1.

In the preferred embodiment, the desired game ball 12 is a soccer ball, and the ball target 10 acts as a goal for receiving and retaining the soccer ball therein. In play, the base 14 of goal 10 is placed on a playing surface 18, FIG. 1, and is capable of receiving a rolling soccer ball 12 thereover, as shown in FIG. 3. The incoming rolling soccer ball 12 then forces a number of side elements 28 inwardly as shown by arrow 42. Since side elements 28 are connected with the threaded flexible cord 32, the action of several side elements 28 compressing inwardly, causes the remaining side elements to contract in a direction opposite of the incoming game ball, thereby stopping the game ball from exiting the opposite side of the goal assembly. Once the game ball 12 rolls over and past the side elements 28, the side elements return to their biased upwardly extending position, which traps the game ball within the goal assembly.

The lengths of side elements 28 are chosen according to the diameter of the game ball, such that as the incoming rolling game ball compresses a number of side elements inwardly and proceeds into the target opening, or receiving area 26, the compressed side elements 28 are only released once the game ball 12 is within striking distance of the opposite side elements. This ensures that the opposite side elements are contracted, or taught, in a direction opposite of the incoming game ball to stop the ball from exiting the opposite end from the incoming direction. The ball then bounces off the taught side elements as the compressed side elements 28 return to their original biased upwardly extending position, and the game ball is trapped within the goal assembly.

In one preferred soccer embodiment, the length of side elements 28 are 6 inches, and the diameter of the target area 26 is 16 inches. The inner diameter 38 measures 20 inches, and the outer diameter 40 is 26 inches. As will be readily discernible from anyone skilled in this art, the ball target of the present invention can be made to accommodate any type of game ball by varying these dimensions. It is contemplated, that the invention is readily adaptable to golf balls, and all the aforementioned specifications would be downsized accordingly. Further, the soccer goal assembly of the present invention may be made larger for outdoor use, than for indoor use. Also, the goal assembly may be made larger or smaller for various games and/or the number of players in a game, besides the type and size of a game ball.

It is recognized that these and other equivalents, alternatives, and modifications are possible within the scope of the appending claims.

I claim:

1. A ball target comprising:

a base having a substantially planar bottom side;

an upwardly extending side assembly having an upper end and a lower end, wherein the lower end is attached to the base, and the upper end forms a target opening; and at least one flexible cord attached to the upper end of the side assembly, wherein pressure on one portion of the side assembly causes contraction on another retaining a game ball in the target opening.

2. The ball target of claim 1 wherein the side assembly further comprises a plurality of upwardly extending side elements.

3. The ball target of claim 2 wherein the upwardly extending side elements have eyelets at an upper end of the side elements, and the flexible cord is threaded through the eyelets connecting the upper end of the side elements thereby forming the target opening.

4. The ball target of claim 1 wherein the base further comprises a ramped upper side extending downwardly from the side assembly attached to the base.

5. The ball target of claim 1 wherein the base is circular.

6. The ball target of claim 1 wherein the base has an outer diameter and an inner diameter thereby forming a hollowed center.

7. The ball target of claim 1 wherein the target opening is further defined as a receiving area for the reception of a game ball.

8. A goal assembly for receiving and retaining a game ball comprising:

a base for placement on a playing surface and capable of receiving a rolling game ball thereover; and a plurality of side elements extending upwardly from the base, wherein the side elements have an upper end and a lower end, wherein the upper ends are connected and the lower ends are flexibly attached to the base, thereby allowing the incoming rolling game ball to compress a number of side elements inwardly and cause a number of remaining side elements to contract in a direction opposite of the incoming game ball and trapping the game ball within the goal assembly.

9. The goal assembly of claim 8 wherein the upwardly extending side elements have an eyelet at the upper end, and the ball target further comprises a flexible cord threaded through the eyelets and connecting the upper ends of the side elements.

10. The goal assembly target of claim 8 wherein the base further comprises a ramped upper side extending downwardly from the bottom end of the side elements attached to the base.

11. The goal assembly of claim 8 wherein the base is circular.

12. The goal assembly of claim 8 wherein the base has an outer diameter and an inner diameter thereby forming a hollowed center.

13. The goal assembly of claim 8 wherein the upper ends of the side elements form a receiving area for the reception of a game ball.

14. A ball target comprising:

a base having a substantially planar bottom side;

an upwardly extending side assembly having an upper end and a lower end, wherein the lower end is attached to the base, and the upper end forms a target opening wherein pressure on one portion of the side assembly causes contraction on another, the side assembly comprising a plurality of upwardly extending side elements having eyelets at an upper end; and a flexible cord threaded through the eyelets connecting the upper ends of the side elements thereby forming the target opening.

* * * * *